United States Patent [19]

Luther et al.

[11] Patent Number: 4,510,932

[45] Date of Patent: Apr. 16, 1985

[54] APPARATUS FOR SUPPLYING DIVERS WITH ARTIFICIAL RESPIRATORY GAS MIXTURES

[75] Inventors: Günter Luther, Wangelau; Peter Loebel, Toppenstedt; Gerhard Risse, Lübeck; Volker Leiser, Cuxhaven, all of Fed. Rep. of Germany

[73] Assignee: GKSS-Forschungszentrum-Geesthacht GmbH, Geesthacht, Fed. Rep. of Germany

[21] Appl. No.: 422,691

[22] Filed: Sep. 24, 1982

[30] Foreign Application Priority Data

Oct. 1, 1981 [DE] Fed. Rep. of Germany ..... 3139039

[51] Int. Cl.[3] ..... A62B 7/00

[52] U.S. Cl. ..... 128/204.29; 128/201.27; 128/205.24

[58] Field of Search ..... 128/201.27, 201.28, 128/205.12, 204.28, 204.29, 204.18, 205.24

[56] References Cited

U.S. PATENT DOCUMENTS 2,732,840 1/1956 De Sanctis ..... 128/205.12

3,195,538 7/1965 Galeazzi ..... 128/205.12

*Primary Examiner*—Henry J. Recla

*Attorney, Agent, or Firm*—Toren, McGeady and Stanger

[57] ABSTRACT

The invention relates to an apparatus for supplying divers with artificial respiratory gas mixtures with a counterlung, which can be fixed to a diver, which is hung on gimbals, which is adjusted independently of the particular floating position of the diver and which collects his exhaled gas. For the construction of a completely closed respiratory gas circuit system, it is constructed as a single-chamber container with a bottom opening and which uses the ambient water as the sealing fluid. The container is provided with a gas outlet connection arranged above the liquid level in the inner area of the container, which can be closed by means of a shutoff device controlled by the rising liquid level and which is connected by means of a waste gas hose line with the surface of the water or the inner area of a diving chamber or bell.

1 Claim, 4 Drawing Figures

APPARATUS FOR SUPPLYING DIVERS WITH ARTIFICIAL RESPIRATORY GAS MIXTURES

Figure 1:
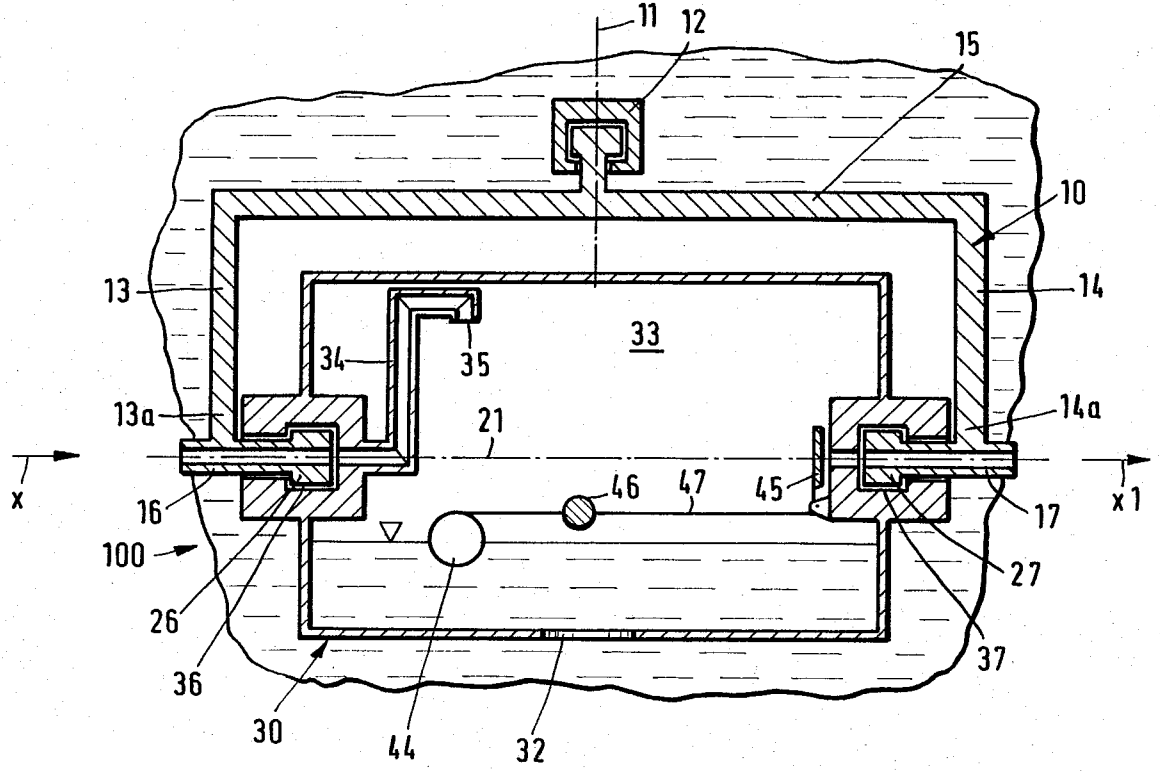

The invention relates to an apparatus for supplying divers with artificial respiratory gas mixtures using respiratory gas carried in a circuit.

It is known to supply divers with artificial respiratory gas mixtures with the aid of a gas circuit system. These respiratory gas mixtures generally contain helium as the additional gas in the case of depths exceeding 50 m. In the case of an open gas supply system, the respiratory gas and the helium are exhaled into the ambient and are therefore lost. However, the hitherto used gas circuit systems involve complicated monitoring and control of the pressure differences, as well as the respiratory gas flows. In the case of a breakdown of the monitoring and control units, the diver is at risk. Additional safety measures are required for overcoming this problem. Important disadvantages of the conventional circuit system are the high purchase price, the additional maintainance and monitoring expenditure, as well as the increased physical burden on the diver.

The problem of the present invention is therefore to provide a gas circuit for supplying divers with artificial respiratory gas mixtures, which lead to no additional gas losses and with which the safety of the diver is considerably increased. In addition, the advantages of a closed respiratory circuit are linked with those of an open system.

According to the invention this problem is solved by an apparatus for supplying divers with artificial respiratory gas mixtures using respiratory gas carried in a circuit, characterized by a counterlung with a sealing fluid using the ambient water, which can be fixed to a diver, is hung on gimbals, which is adjusted independently of the particular floating position of the diver and which collects the gas which he exhales. The counterlung is provided with an opening for the water intake, the opening being constructed so that it is automatically set in the direction of the centre of the earth.

The counterlung used for the apparatus for supplying divers with artificial respiratory gas mixtures comprises a U-shaped mounting support, mounted so as to rotate about a vertical axis in a device for fixing the counterlung to a diver and whose free ends carry facing, equiaxial pipe connections, constructed as swivel bearings, for the hose supply to an automatic lung and for the waste gas hose supply to the surface of the water or to the inner area of a diving chamber, as well as a closed container mounted so as to rotate about a horizontal axis in the swivel bearings of mounting support, this container having at the bottom an opening, an upper gas space with a gas outlet pipe issuing into the latter and connected to the pipe connection for the hose supply to the automatic lung having a gas outlet port located in the upper area of the gas space and a lower receiving space for the liquid flowing through the bottom opening into container, as well as a shutoff device for the gas outlet pipe connection controllable by the level of the liquid in the inner area of the container by means of a float or the like.

The apparatus constructed in accordance with the invention leads to a circuit process for the supply of divers with respiratory gas, whilst incorporating a gas treatment process. The counterlung integrated with the diver maintains the pressure difference between the lung and the ambient in the permitted range independently of the depth, the supplied quantity of gas and the pressures in the supply and waste gas lines for any random floating position of the diver. The gas loss cutoff means is here constituted by an automatically setting water column which, as a result of the "suspension on gimbals" allows all movements of the diver in free water and supplies him with respiratory gas independently of his floating position. The supply and removal of the gas requires no complicated control. In the case of a break of the gas supply and/or removal lines the apparatus in the manner of a device with an open circuit, without the diver being exposed to any additional danger. Even in the case of the two supply hoses blocking or jamming, or in the case of a failure of the safety valves, due to the open-working system, no increased pressures occur in the breathing area of the diver. The apparatus works independently of the depth. Diving safety is increased in spite of the limited costs.

The invention also relates to the use of a counterlung hung on the diver by means of gimbals, which is adjusted independently of the particular floating position of the diver, which collects the expired respiratory gas and which uses the ambient water as a sealing fluid, for the purpose of supplying divers with artificial respiratory gas mixtures carried in a circuit.

Embodiments of the invention are described hereinafter relative to the drawings, wherein show:

FIG. 1 the counterlung of the apparatus for supplying divers with artificial respiratory gas mixtures, partly in projection and partly in a vertical section.

Figure 2:
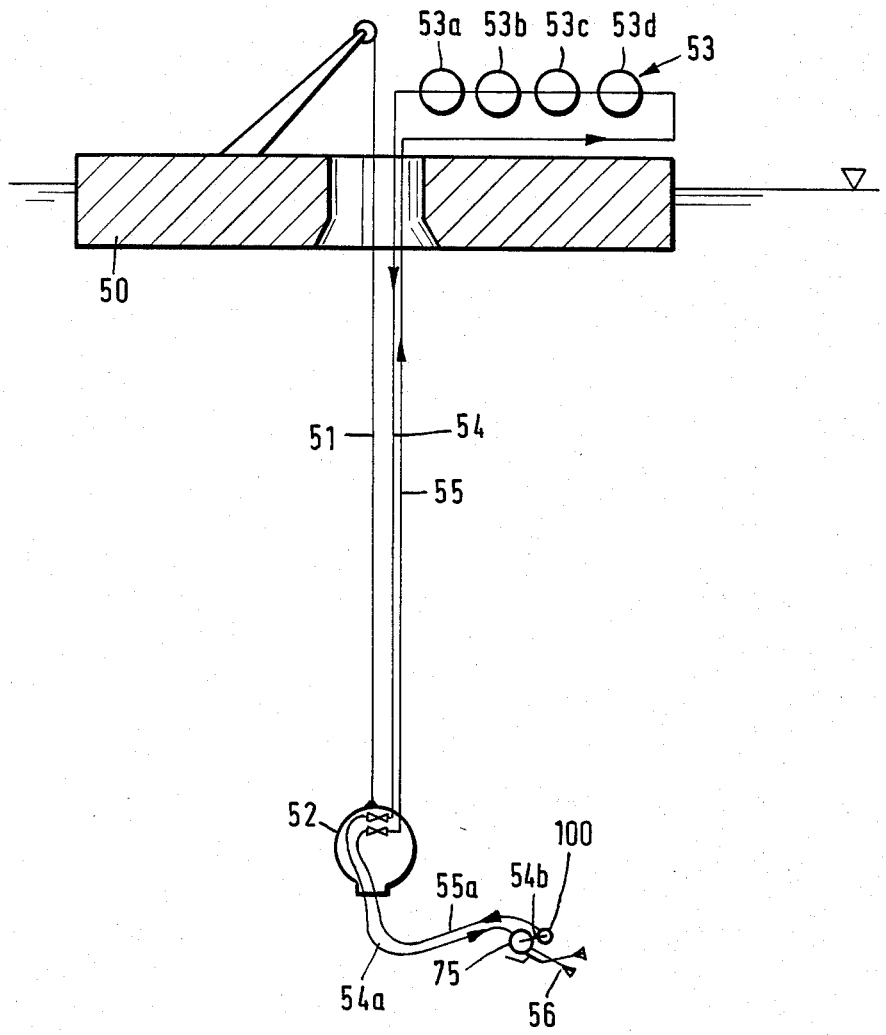

FIG. 2 an installation for using the apparatus for supplying divers with artificial respiratory gas mixtures for working underwater, employing a diving chamber, in a diagrammatic view.

Figure 3:
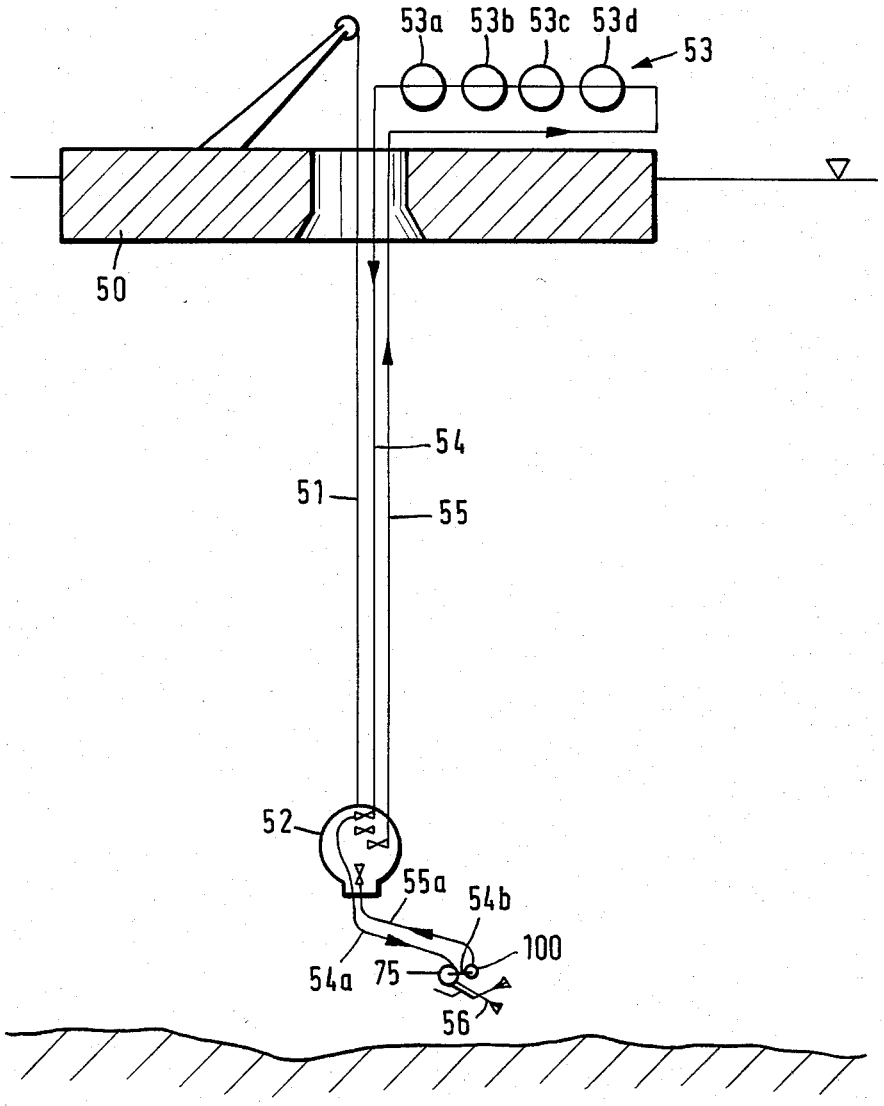

FIG. 3 another embodiment of the complete installation of FIG. 2 in a diagrammatic view.

Figure 4:
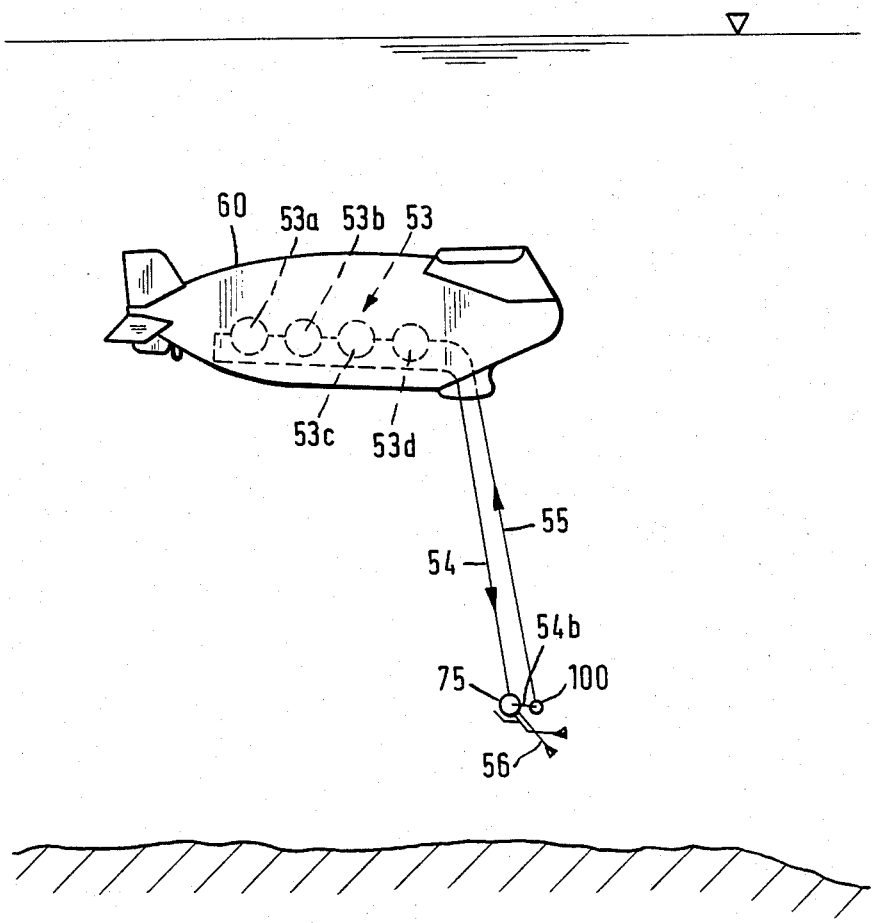

FIG. 4 the complete installation for working underwater with a gas treatment plant installed in a submarine in a diagrammatic view.

The apparatus for supplying divers with artificial respiratory gas mixtures has a counterlung 100 which, in accordance with the embodiment of FIG. 1, comprises a U-shaped mounting support 10, whose two legs are 13, 14 and the connecting web is 15. Mounting support 10 is held in a fixing device 12, so as to be pivotable about a vertical axis 11 and by means of device 12 counterlung 100 can be connected to a diver by using suitable holding devices.

The free ends 13*a*, 14*a* of the two legs 13, 14 of mounting support 10 carry pipe connections 16, 17, which are approximately equiaxial to one another and whereof pipe connection 16 is connected via a gas supply hose 54*b* to an automatic lung 75, constructed in per se known manner, whilst pipe connection 17 is connected to a gas removal hose 55*a*, which leads to the surface of the water or to the inner area of a diving chamber (FIGS. 2 and 3). In addition, the pipe connections 16, 17 are constructed externally as swivel bearings 26, 27 for a container 30 pivotable about a horizontal axis 21 and which is provided for holding in swivel bearings 26, 27 with sleeve-like abutments 36, 37 which engage around said bearings 26, 27, so that container 30 can be pivoted about horizontal axis 21 in mounting support 10. As a result of the arrangement of mounting support 10 and container 30 therein, said container is hung on gimbals.

Container 30 is constructed in closed manner and has at the bottom an opening 32, through which the ambient water can flow into the inner area of the container. In container 30 are provided a lower receiving area 43 for the water flowing in through opening 32 and an overlying gas space 33 into which issues a gas outlet pipe 34 connected to connection 16. The outlet port 35 of pipe 34 is located in the upper area of gas space 33, so that the gas flowing from the automatic lung 75 in the direction of arrow X flows through pipe connection 16 into gas outlet pipe 34 and passes through its outlet port 35 into the upper gas space 33.

The inflow port of pipe connection 17 can be closed by means of a shutoff device 45, which can be constructed as a throttle valve or the like. Shutoff device 45 is controlled as a function of the height of the liquid level in container 30 by means of a float 44, which is connected to device 45 by a control rod 47 carrying a weight 46 in such a way that when the liquid rises in the inner area of container 30, device 45 closes the inflow opening of pipe connection 17. When the shutoff device 45 is open, the gas flows out of gas space 33, through pipe connection 17, via the waste gas hose to the surface or into the inner area of a diving chamber.

The counterlung 100 functions as follows. Gas is supplied to the diver by means of the automatic lung 75 or automatic equipment if diving is taking place with a helmet. The exhaled gas passes via gas supply hose **54*b* into container 30 of counterlung 100. As a result of overpressure, the level of the water located in the inner area of container 30 drops. Float 40 follows this movement and releases the opening of pipe connection 17. Thus, the gas can pass through pipe connection 17 and the linked gas removal hose to the surface or into a diving chamber. However, this only takes place if the diver is at a greater depth than the gas collecting station. Otherwise a pump must be used in order to maintain a pressure difference. The gas flowing out of container 30 leads to a rise in the water level. This movement is followed by float 44 and by means of the shutoff device 45, closes the gas inflow opening of pipe connection 17**.

For the completely satisfactory operation of this system, it is necessary for the opening 32 in container 30 always to point in the direction of the centre of the earth. This is made possible by container 30 being mounted in a twice-rotatable manner, namely on the hose connections 16, 17 and on the fixing device 12. Through weights or buoyancy means on container 30, the latter remains in the same position when the diver is in any random floating position, i.e. the opening 32 of said container always points towards the centre of the earth.

This operation of the system is still ensured if no float 44 and shutoff device 45 are used. It must then be ensured by continuously flowing additional air, so that the water level in container 30 is kept below the inflow opening of pipe connection 17.

The use of counterlung 100 in the supply apparatus constructed according to the invention is shown by means of the embodiments of FIGS. 2 to 4.

The installation according to FIG. 2 comprises an equipment carrier 50, e.g. a ship, with a treatment station 53, which comprises a buffer battery **53*a*, a gas treatment means 53*b*, a pressure increasing device 53*c* and a water separator 53*d*. By means of an extendable and retractable suspending wire 51 a diving chamber 52 is connected to the equipment carrier 50. The supply hoses 54, 55 are connected to chamber 52, as well as to the treatment station 53. The gas supply takes place by means of hose 54 and gas removal by means of hose 55**.

The gas supplied by means of supply hose 54 is supplied to the automatic lung 75 by means of a hose line **54*a* connected to said hose. The connection for the diver is indicated at 56. Automatic lung 75 is connected to counterlung 100 by means of hoseline 54*b*. a hoseline 55*a* is connected to the counterlung for removing the gas and as a result thereof, as well as hose 55 the gas is returned to the treatment station 53. In this construction, the respiratory air supply and removal with respect to the diver and diving chamber are separate. The exhaled gas of the diver reaches the surface, is treated in station 53** and returned to the diver.

In the embodiment of FIG. 3 the equipment carrier 50, which carries the treatment station 53 with means **53*a*, 53*b*, 53*c* and 53*d* is connected by means of the suspending wire 51 to diving chamber 52, by means of which the corresponding underwater work is carried out. Provided that the diver is working below the diving chamber, it is possible to pass the waste gas hose 55*a* from the diver directly into the inner area of diving chamber 52. The quantity of gas which is then supplied is then simultaneously used for scavenging the diving chamber with respiratory gas. The diving chamber is then connected via hose 54 or 55 with the treatment station 53. The treated gas is supplied to the diver via supply hose 54 and hoseline 54*a*, accompanied by the interposing of the automatic lung 75**.

If the diver is working above the entry opening of the diving chamber, the aforementioned plant can be used as an open system, i.e. the diver exhales air into the ambient water. Quite independently of this, it is possible by means of a compressor on or in the diving chamber to suck in respiratory gas and force it into the diving chamber.

Another embodiment of the complete plant is shown in FIG. 4 in which the gas treatment station 53 is located in a submarine 60. This treatment station 53 is connected by means of supply hoses 54, 55 to automatic lung 75. Gas supply takes place by means of hose 54, whilst gas is removed from the counterlung 100 connected to automatic lung 75 by means of hose 55.

The invention is not restricted to the embodiments described hereinbefore and shown in the drawings. The scope of the invention covers variations in the construction of counterlung 100 and different mounting and suspension of container 30. However, in all embodiments it must be ensured that there is a gimbal suspension, so that the water column which is automatically regulated in the counterlung permits all movements of the diver in the free water.

We claim:

1. An apparatus for supplying divers with artificial respiratory gas mixtures, comprising a counterlung arranged to be worn by a diver, support means for said counterlung including swivel bearings for adjusting the position of said counterlung independently of the floating position of the diver, said counterlung comprises walls forming a chamber having a bottom and a top spaced upwardly from the bottom, said bottom having an opening communicating with the chamber for admitting ambient water into the chamber so that a water level is formed within the chamber dividing the chamber into a lower water space and an upper gas space, means within said chamber for forming an exhaled gas inlet communicating with the gas space with the exhaled gas flowing from the exhaled gas inlet into direct contact with the water level, means within said chamber for forming a gas outlet for removing gas from the gas space in the chamber and conveying the gas out of the chamber, said gas inlet located adjacent the top of said chamber and said gas outlet located between said gas inlet and the water level, means in said chamber for closing said gas outlet in response to the water level within said chamber, said means for closing said gas outlet comprises a valve positioned within said chamber and arranged to close said gas outlet, a control rod having opposite ends and pivotally mounted in said chamber at a point intermediate said opposite ends, said pivot dividing said control rod into first and second leg portions each terminating in said opposite ends, said valve being attached to said end of said first leg portion, a float attached to said end of said second leg portion, a weight attached to said second leg portion intermediate said pivot and float, said control rod being oriented within said chamber such that said second leg portion moves toward and away from said opening whereby said float follows the movement of the water level within said chamber, said means for forming the exhaled gas inlet includes a tube forming said exhaled gas inlet within said chamber and extending upwardly from the gas inlet and then downwardly toward and spaced from the water level where said tube extends outwardly from said chamber in axial alignment within said gas outlet.

* * * * *